US006026981A

United States Patent [19]

Thizy et al.

[11] Patent Number: 6,026,981

[45] **Date of Patent: *Feb. 22, 2000**

[54] ONE-PIECE AEROSOL CAN OF ALUMINIUM

[75] Inventors: Christian Thizy, Manthes; Frank-Olivier Duport, La Forteresse, both of France

[73] Assignee: Alusuisse Technology & Management, Ltd., Neuhausen am Rheinfall, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/825,092

[22] Filed: Mar. 27, 1997

[30] Foreign Application Priority Data

Mar. 28, 1996 [EP] European Pat. Off. ..... 96810195

[51] Int. Cl.[7] ..... B65D 8/00

[52] U.S. Cl. ..... 220/682; 220/608; 220/619

[58] Field of Search ..... 220/601, 604, 220/608, 619, 682; 222/635

[56] References Cited

U.S. PATENT DOCUMENTS

| | | | |
|---|---|---|---|
| 3,231,152 | 1/1966 | McKiever | 220/608 X |
| 4,775,071 | 10/1988 | Giggard | 220/619 |

FOREIGN PATENT DOCUMENTS

| | | |
|---|---|---|
| 2248210 | 5/1975 | France . |
| 3625962 | 11/1988 | Germany . |
| 1448334 | 9/1976 | United Kingdom . |

*Primary Examiner*—Steven Pollard
*Attorney, Agent, or Firm*—Fisher, Christen & Sabol

[57] ABSTRACT

A one-piece aerosol can (20) of aluminum with integral end cap (24) for attaching a valve plate is such that the end cap (24) is adapted to match the outer contour of an end cap (14) which is flanged or folded onto the body (12) of a three-piece aerosol can (10) of tin plated sheet can be attached in an identical manner to the integrally formed end cap (24) of the one-piece aerosol can of aluminum. The specific design of the integrally formed end cap on the one-piece can of aluminum makes the interchangeability of accessories between both types of can possible.

9 Claims, 1 Drawing Sheet

ONE-PIECE AEROSOL CAN OF ALUMINIUM

BACKGROUND OF THE INVENTION

1. Field of the Invention

The invention relates to a one-piece aerosol can of aluminium with integral end cap for attaching a valve plate.

2. Background Art

The known three-part aerosol cans exhibit a can body made from a rectangular sheet into a cylindrical shape with a longitudinal welded seam, the ends of which cans are provided with a base part and an end cap for attaching a valve plate. The air-tight and fluid-tight connection between the can body and both end parts is normally effected by a so-called double fold with interlying sealing mass. Instead of being folded, both end parts may also be flanged onto the can body. In order to be able to satisfy the requirements made regarding the pressure tightness of filled aerosol cans, the base part is normally domed in a convex manner towards the interior of the can. The end cap for attaching the valve plate is likewise adapted to suit the pressure conditions and, furthermore, also designed appropriately to accommodate fittings such as a plastic protective cap, facilities for protecting the valve or special dispensing devices.

One-piece aerosol cans of aluminium are characterised by the fact that the can body, base part and end cap are integrally formed by press-forming and drawing in the neck.

The different shapes of one-piece and three-piece aerosol cans and the basically different methods for manufacturing them have in the past led to development of different types of end cap for the two types of aerosol can. As a result, the accessories for one-piece aerosol cans of aluminium and three-piece aerosol cans of tin plated steel are not interchangeable.

BROAD DESCRIPTION OF THE INVENTION

In view of this the object of the present invention is to provide a one-piece can of aluminium of such a kind that the accessories for one-piece aerosol cans of aluminium and three-piece aerosol cans of tin plated steel are interchangeable, i.e. in particular that the existing accessories for three-piece aerosol cans of tin plated steel may be employed for the one-piece aerosol cans of aluminium.

That objective is achieved by way of the invention in that the end cap is adapted to match the outer contour of an end cap which is flanged or folded onto the body of a three-piece aerosol can of tin plated steel, and namely such that accessories designed to fit onto the end cap of the three-piece aerosol can of tin plated sheet can be attached in an identical manner to the integrally formed end cap of the one-piece aerosol can of aluminium.

The integrally formed end cap on the one-piece aerosol can of aluminium preferably exhibits the same dimensions and functional properties as the end cap on the three-piece aerosol can of tin plated sheet. In particular, the integrally formed end cap on the one-piece aluminium can is provided with a shoulder which corresponds to the flanged or folded edge on the end cap of the three-piece aerosol can of tin plated sheet.

BRIEF DESCRIPTION OF THE DRAWING

Further advantages, features and details of the invention are revealed in the following description of a preferred exemplified embodiment of the invention and with the aid of the drawing which shows schematically in FIG. 1 a partially sectioned end view of an end cap flanged onto the body of a three-piece aerosol can of tin plated sheet.

DETAILED DESCRIPTION OF THE INVENTION

Figure 1:
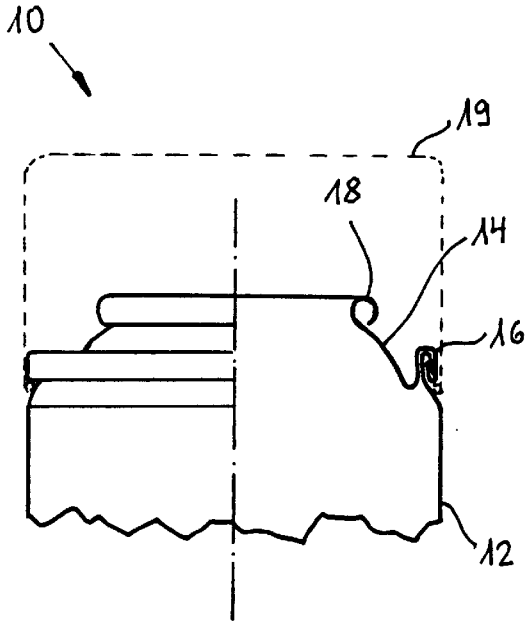

A three-piece aerosol can 10 of tin plated sheet features an end cap 14 for accommodating a valve plate where the said end cap 14 is joined to the can body 12 via a double fold 16 in an air-tight and fluid-tight manner. The double fold 16 serves e.g. as retaining means for a correspondingly shaped plastic protective cap 19.

Figure 2:
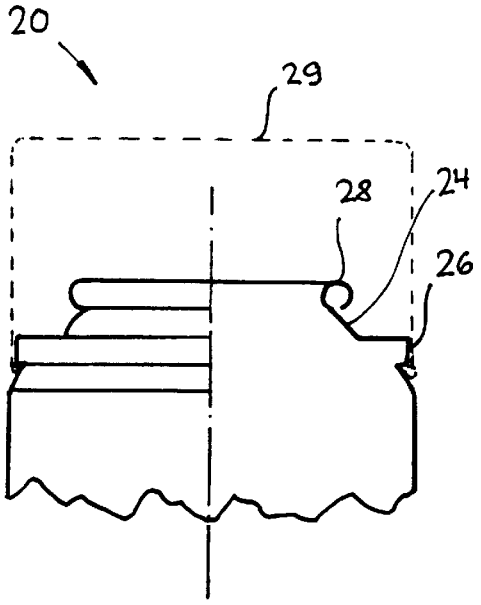
FIG. 2 a partially sectioned end view of an integrally formed end cap on the body of a one-piece aerosol can of aluminium.

FIG. 2 shows the integrally shaped end cap of a one-piece aerosol can of aluminium, the outer contour of which simulates the outer contour of the design shown in FIG. 1. For example the integral shoulder 26 on the aerosol can of aluminium corresponds to the double fold 16 on the three-piece aerosol can of tin plated steel sheet, and serves to retain a protective cap 29 which is identical to protective cap 19. In order to accommodate a valve plate, the upper edge of the integrally shaped end cap 20 is shaped in the same way as a state of the art flanged edge 28 on the can shown in FIG. 1.

What is claimed is:

1. One-piece aerosol can of aluminum with integral end cap (24) for attaching a valve plate, characterized in that, the end cap (24) is adapted to match the outer contour of an end cap (14) which is flanged or folded onto the body (12) of a three-piece aerosol can (10) of tin plated steel, and namely such that accessories (19, 29), which are designed to fit onto the end cap (14) of the three-piece aerosol can (10) of tin plated sheet, can be attached in an identical manner to the integrally formed end cap (24) of the one-piece aerosol can (20) of aluminum, the integrally formed end cap (24) on the one-piece aerosol can (20) of aluminum has a protruding shoulder (26) which corresponds to the flanging or folding edge (16) on the end cap (14) of the three-piece aerosol can (10) of tin plated sheet, the shoulder (26) being located on the outer contour of end cap (24) such that when accessory (29) is fitted onto the end cap (24) the inner surface of accessory (29) is fitted onto the end cap (24) so as to contact the outer surface of the end shoulder (26), also when accessory (29) is fitted onto end cap (24), the outer surface of accessory (29) is flush with the outer surface of the body of the one-piece aerosol can (20), the diameter of the outer surface of the protruding shoulder (26) of the integrally formed end cap (24) of the one-piece aerosol can (20) is the same as the diameter of the outer surface of the flanging or folding edge (16) of the end cap (14) of the three-piece aerosol can (10).

2. Aerosol can according to claim 1, characterised in that the integrally formed end cap (24) on the one-piece aerosol can (20) of aluminium exhibits the same dimensions and functional properties as the end cap (14) on the three-piece aerosol can (10) of tin plated sheet.

3. Aerosol can according to claim 1, characterised in that the integrally formed end cap (24) on the one-piece aerosal can (20) of aluminum features a shoulder (26) which corresponds to the flanging or folding edge (16) on the end cup (14) of the three-piece aerosol can (10) of tin plate sheet.

4. Aerosol can according to claim 1, characterized in that the integrally formed end cap (24) on the one-piece aerosol can (20) of aluminium features a shoulder (26) which corresponds to the flanging or folding edge (16) on the end cap (14) of the three-piece aerosol can (10) of tin plated sheet.

5. Aerosol can according to claim 1 characterized in that the region of the can body of the one-piece aerosol can (20), said region being next to and intersecting with the protruding shoulder (26), slants inwardly as the region progresses toward the cap end of the one-piece aerosol can (20) and forms an acute angle with the longitudinal axis of the one-piece aerosol can (20) in the portion of said region which is proximate to the intersection of said region and the protruding shoulder (26).

6. Aerosol can according to claim 5 characterized in that the rim of the opening of the accessory (29) only abuts or contacts the can body of the one-piece aerosol can (20) at said portion of said region which forms said acute angle.

7. Aerosol can according to claim 5 characterized in that the outer diameter of the rim portion of the accessory (29) is the same as the outer diameter of the portion of the can body of the one-piece aerosol can (20) which is proximate to said inwardly slanted region of the can body of the one-piece aerosol can (20).

8. Aerosol can according to claim 7 characterized in that the accessory (29) is a protective cap.

9. One-piece aerosol can of aluminum with integral end cap (24) for attaching a valve plate, characterized in that, the end cap (24) is adapted to match the outer contour of an end cap (14) which is flanged or folded onto the body (12) of a three-piece aerosol can (10) of tin plated steel, and namely such that accessories (19, 29), which are designed to fit onto the end cap (14) of the three-piece aerosol can (10) of tin plated sheet, can be attached in an identical manner to the integrally formed end cap (24) of the one-piece aerosol can (20) of aluminum, the integrally formed end cap (24) on the one-piece aerosol can (20) of aluminum has a protruding shoulder (26) which corresponds to the flanging or folding edge (16) on the end cap (14) of the three-piece aerosol can (10) of tin plated sheet, the shoulder (26) being located on the outer contour of end cap (24) such that when accessory (29) is fitted onto the end cap (24) the inner surface of accessory (29) is fitted onto the end cap (24) so as to contact the outer surface of the end shoulder (26), also when accessory (29) is fitted onto end cap (24), the outer surface of accessory (29) is flush with the outer surface of the body of the one-piece aerosol can (20), the can body of the one-piece aerosol can (20) of aluminum and the can body (12) of the three-piece aerosol can (10) of tin plated steel are both of a cylindrical shape, the one-piece aerosol can (20) of aluminum has the same outer diameter as the can body (12) of the three-piece aerosol can (10) of tin plated steel.

* * * * *